US008182177B2

(12) United States Patent
Morizot et al.

(10) Patent No.: US 8,182,177 B2
(45) Date of Patent: May 22, 2012

(54) REINFORCED STABILISING STRIP INTENDED FOR USE IN REINFORCED EARTH STRUCTURES

(75) Inventors: Jean-Claude Morizot, Paris (FR); Nicholas Freitag, Orsay (FR)

(73) Assignee: Terre Armee Internationale, Velizy Villacoublay (FR)

( * ) Notice: Subject to any disclaimer, the term of this patent is extended or adjusted under 35 U.S.C. 154(b) by 6 days.

(21) Appl. No.: 12/671,284

(22) PCT Filed: Jul. 24, 2008

(86) PCT No.: PCT/FR2008/051397

§ 371 (c)(1),
(2), (4) Date: Jan. 29, 2010

(87) PCT Pub. No.: WO2009/024700

PCT Pub. Date: Feb. 26, 2009

(65) Prior Publication Data

US 2010/0254770 A1 Oct. 7, 2010

(30) Foreign Application Priority Data

Jul. 31, 2007 (FR) ..... 07 05580

(51) Int. Cl.
*E02D 29/02* (2006.01)

(52) U.S. Cl. ..... 405/262; 405/284

(58) Field of Classification Search ..... 405/262, 405/284, 285, 286

See application file for complete search history.

(56) References Cited

U.S. PATENT DOCUMENTS

| | | | | | |
|---|---|---|---|---|---|
| 4,116,010 | A * | 9/1978 | Vidal | 405/262 |
| 4,960,349 | A * | 10/1990 | Willibey et al. | 405/262 |
| 5,573,852 | A | 11/1996 | Thal | |
| 5,795,835 | A | 8/1998 | Brunner et al. | |
| 5,890,843 | A * | 4/1999 | Bastick et al. | 405/262 |
| 6,056,479 | A * | 5/2000 | Stevenson et al. | 405/262 |
| 7,789,590 | B2 * | 9/2010 | Morizot et al. | 405/262 |
| 7,959,752 | B2 * | 6/2011 | Yun et al. | 405/262 |
| 2006/0116040 | A1 * | 6/2006 | Yun et al. | 442/2 |

FOREIGN PATENT DOCUMENTS

| | | |
|---|---|---|
| BE | 896 030 | 6/1983 |
| DE | 37 28 255 | 3/1989 |
| FR | 873 354 | 7/1942 |
| JP | 06-299470 | 10/1994 |
| JP | 60-96441 | 11/1994 |
| WO | WO 95/11351 | 4/1995 |
| WO | WO 98/06570 | 2/1998 |

OTHER PUBLICATIONS

International Search Report and Written Opinion dated Jan. 21, 2009 for Application No. PCT/FR2008/051397.

* cited by examiner

*Primary Examiner* — Frederick L Lagman
(74) *Attorney, Agent, or Firm* — Frost Brown Todd LLC

(57) ABSTRACT

Reinforced stabilizing strip (10) intended for use in reinforced earth structures, comprising a longitudinal part (12), said longitudinal part (12) comprising along at least part of its length, at least one cord (14) arranged approximately longitudinally and encased in the bulk of said longitudinal part.

9 Claims, 4 Drawing Sheets

REINFORCED STABILISING STRIP INTENDED FOR USE IN REINFORCED EARTH STRUCTURES

BACKGROUND OF THE INVENTION

1. Field of Invention

This invention relates to a reinforced stabilising strip intended for use in reinforced earth or strengthened soil structures, together with the use of such a strip for the construction of reinforced earth or strengthened soil structures.

2. Description of the Prior Art

A reinforced earth structure combines compacted backfill, a facing and reinforcements that are connected or not to the facing.

Various types of reinforcement can be used: metal, for example galvanised steel, or stabilising strips, for example polyester fibre-based. They are placed in the earth at a density that depends on the stresses that are likely to be exerted on the structure, with the thrust stress of the ground being taken up by the friction between the earth and the reinforcements.

The facing is usually made from precast concrete elements in the form of slabs or blocks, juxtaposed to cover the front surface of the structure.

In the great majority of cases, the reinforcements are provided in the form of strips approximately 3 to 10 metres in length, although shorter or longer strips can be used.

The width of the strips is generally between 4 and 6 centimetres, although it is possible to use strips ranging from 10 to 25 centimetres in width, or even more. Their thickness varies, for example, between approximately 1 millimetre and a few centimetres, and is generally between 1 and 6 millimetres.

Non-reinforced strips or strips reinforced by means of metal rods or parallel fibres or strands of yarn exist.

The aim of the stabilising strips is to transmit the forces into the soil or the earth and thus distribute the stresses.

In particular, it is necessary to transmit the forces between a strip and the backfill in which it is placed. The strip must therefore have a sufficient surface area to develop, through friction, the required shear strength per unit of length.

Moreover, the strip is preferably capable of transmitting the stresses along its entire length, and therefore has high tensile strength.

One solution known to a person skilled in the art consists of using strips comprising a longitudinal part in the form of a central part to withstand a tensile force, the central part having two lateral parts that protrude laterally on either side of the central part to rub against the earth, the central part comprising a set of fibres arranged parallel to each other in such a way as to increase the tensile strength.

Another solution consists of using parallelipedal polyethylene strips reinforced with polyester fibres arranged parallel to each other in the bulk of said strip.

In the prior art, the internal reinforcements of the strips are made up of approximately parallel bundles of strands of yarn approximately parallel to each other. Such an arrangement of the fibres poses the risk of sliding between fibres and between a group of fibres and the strip, and thus a reduction in the transmission of the stress between the earth and the part of the strip with tensile strength.

One object of this invention is to propose another solution that allows for the forces to be transmitted between a strip and the backfill in which it is placed, that has high tensile strength and that limits the risk of sliding between fibres and between a group of fibres and the strip.

The invention thus proposes a reinforced stabilising strip intended for use in reinforced earth structures, comprising a longitudinal part, said longitudinal part comprising along at least a part of its length, at least one cord arranged approximately longitudinally and embedded in the bulk of said longitudinal.

SUMMARY OF THE INVENTION

Advantageously, the cord has high tensile strength and increases the internal cohesion between the fibres. In addition, the arrangement of the fibres or yarn in the form of a cord or rope allows for better anchoring of the fibres or yarn inside the longitudinal part.

A stabilising strip according to the invention can also comprise one or more of the optional characteristics below, taken individually or in any possible combination:

- the material forming said longitudinal part is polymer-based, for example polyethylene-based;
- the material forming the fibres or yarn of the cord is polymer-based, for example polyester-based;
- said longitudinal part is presented in the form of at least one central part, said central part having at least one lateral part that protrudes laterally along the longitudinal part to rub against the earth;
- the lateral part extends longitudinally;
- the longitudinal part comprises several central parts connected to each other by a lateral part;
- the cord is a cord braided from at least three fibres, and in particular from at least six fibres;
- the cord is a cord twisted from at least three fibres, and in particular from at least six fibres;
- the cord comprises a central core.

Another object of the invention is the use of a stabilising strip according to the invention for the construction of a reinforced earth structure.

The invention also relates to a reinforced earth structure comprising at least one stabilising strip according to the invention.

A further object of the invention is a construction method for a reinforced earth structure, in which a facing is arranged over a front surface of the structure delimiting a volume to be backfilled, reinforcements are arranged in one zone of said volume, backfill material is placed in said volume and the backfill material is compacted, in which said reinforcements comprise at least one stabilising strip according to the invention.

BRIEF DESCRITION OF THE DRAWING

The invention will be better understood on reading the following description, given as an example only and with reference to the appended drawings, in which.

DETAILED DESCRIPTION

In the sense of the invention, "cord" is given to mean an assembly, for example obtained by twisting or braiding, of at least three fibres made up of a plurality of strands of yarn or directly of at least three strands of yarn, made from textile, synthetic, plastic or metal materials or a combination of these different fibres or yarns. It is known to a person skilled in the art that the at least three fibres making up a cord are assembled in such a way as to form a stable construction.

The yarns in the sense of the invention are made up of a group of monofilaments and/or discontinuous fibres and/or fibrillated yarn assembled and twined.

A cord according to the invention can comprise at least three strands, each strand being made up of a plurality of fibres assembled in such a way as to form a stable construction.

A cord according to the invention can be a plaited cord in the sense of standard NF EN ISO 1968, namely obtained by braiding together strands to form a stable construction that will not untwine.

A cord according to the invention can be a twined cord in the sense of standard NF EN ISO 1968, namely obtained by twining strands to form a stable construction that will not untwine.

A cord according to the invention can comprise several groups of fibres combining groups of parallel fibres assembled in such a way as to form a stable construction, for example surrounded by woven or twisted fibres.

The cords chosen can for example be narrow, with a diameter in the region of one millimetre, or thicker, with a diameter in the region of one centimetre.

For reasons of clarity, the various components shown in the figures are not necessarily to scale.

"Longitudinal part" is given to mean the part of the stabilising strip that extends lengthways, along the longitudinal axis of said strip.

Figure 1:
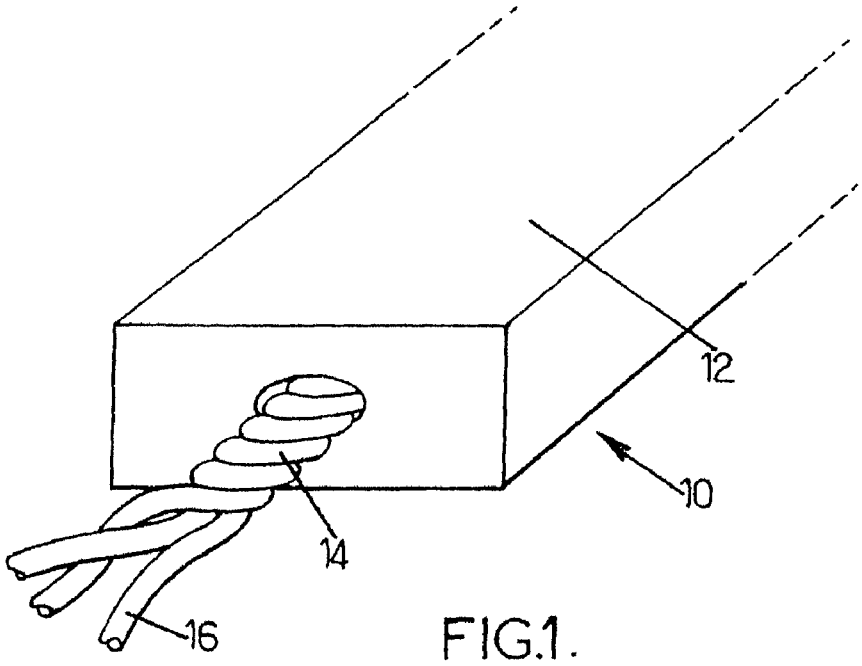
FIG. 1 is a perspective view of a first embodiment with a twisted cord.

FIG. 1 shows a perspective view of a first embodiment of a stabilising strip according to the invention.

In this first embodiment the reinforced stabilising strip 10 according to the invention, comprises a longitudinal part 12 comprising along its entire length a cord 14, said cord 14 is embedded in the bulk of said longitudinal part 12.

The longitudinal part can be made from a plastic material such as polyethylene, polypropylene or PVC.

In this embodiment the cord is an assembly of three twisted fibres 16. The fibres 16 that form the cord 14 can be metal, synthetic, polymeric, for example made of polyester, polyamide or polyolefin, or natural, for example hemp-based, or a combination of these different fibres.

Figure 2:
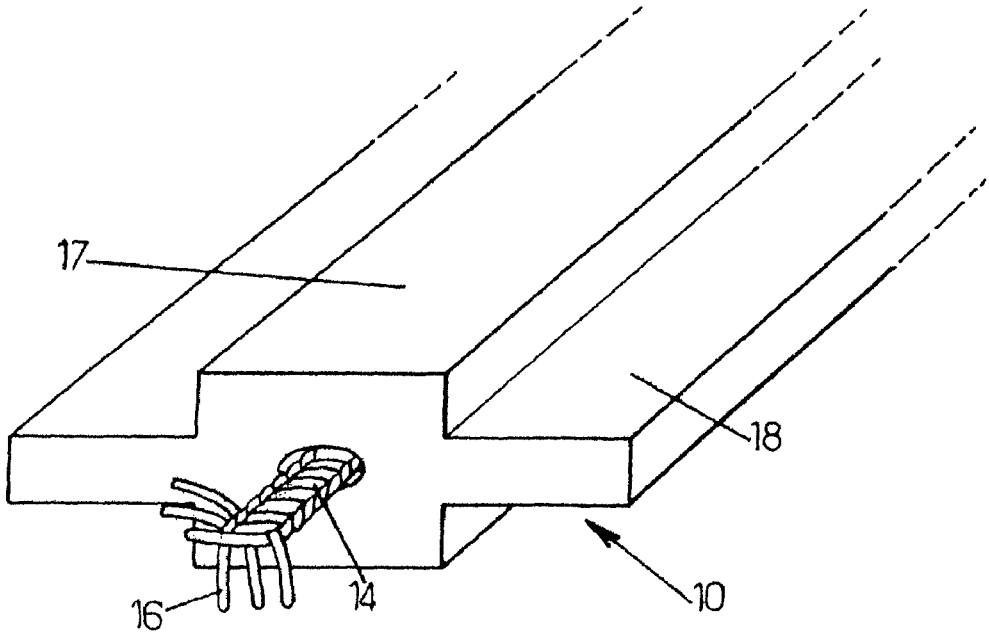
FIG. 2 is a perspective view of a second embodiment with a braided cord.

In another embodiment, shown in FIG. 2, said longitudinal part 12 of the stabilising strip 10 according to the invention, is in the form of a central part 17, said central part 17 having two lateral parts 18, in the form of wings, which protrude laterally to rub against the earth.

The longitudinal part 12 extends laterally on both sides, but could equally only extend on one side.

In this embodiment, the cord 14 is braided from six fibres 16.

The wings 18 can be equipped with ribs and/or undulations and/or perforations or with any other means known to a person skilled in the art to improve the frictional interaction with the earth.

Figure 3:
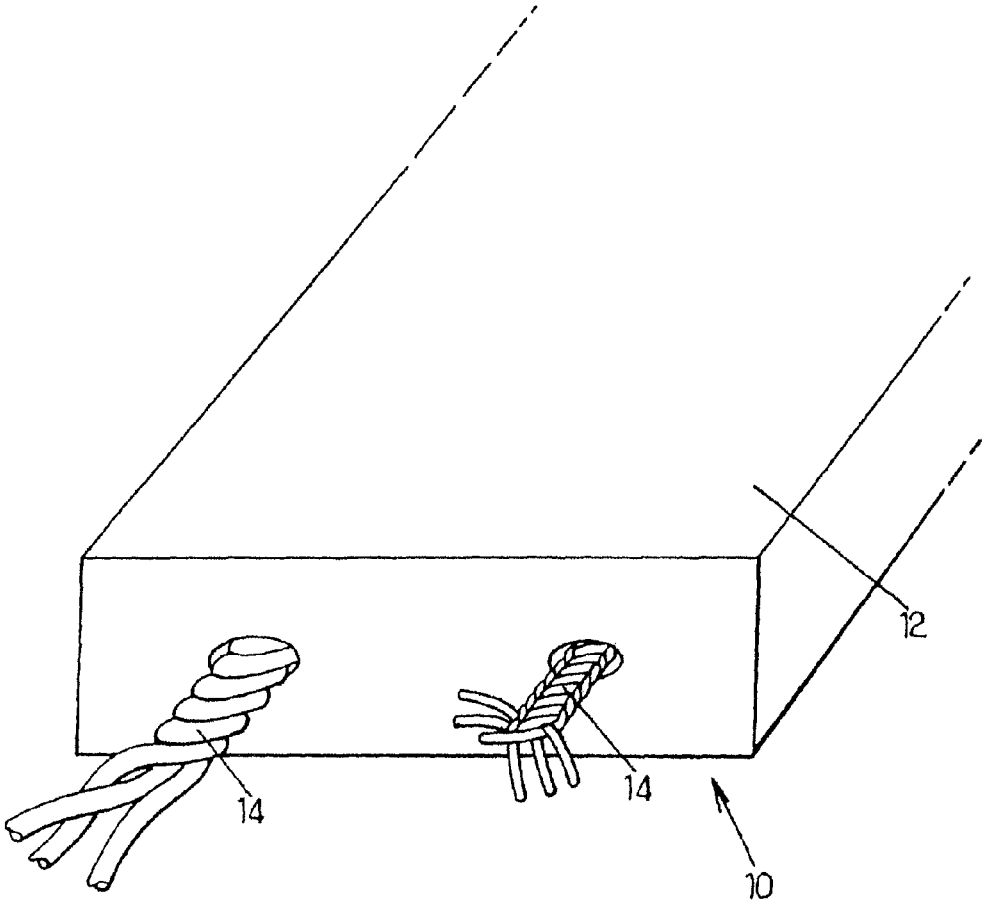
FIG. 3 is a perspective view of a third embodiment with two different cords.

According to another embodiment shown in FIG. 3, the strip according to the invention can comprise several cords of the same type or different types, the cords being embedded in the bulk of the longitudinal part 12 of said strip.

Each cord 14 can extend over just a part of the length of the stabilising strip 10.

The cords 14 can contain a central core in order to increase their diameter and thus the contact area between the outer fibres and the material forming the longitudinal part of the stabilising strip 10.

The strip according to the invention can also comprise a longitudinal part reinforced with a multitude of cords, for example narrow cords distributed approximately evenly throughout the bulk.

A strip according to the invention can be produced, for example, by extrusion, co-extrusion, rolling or any other technique known to a person skilled in the art for producing metal or polymer strips.

The invention also relates to a construction method for a reinforced earth structure.

Figure 4:
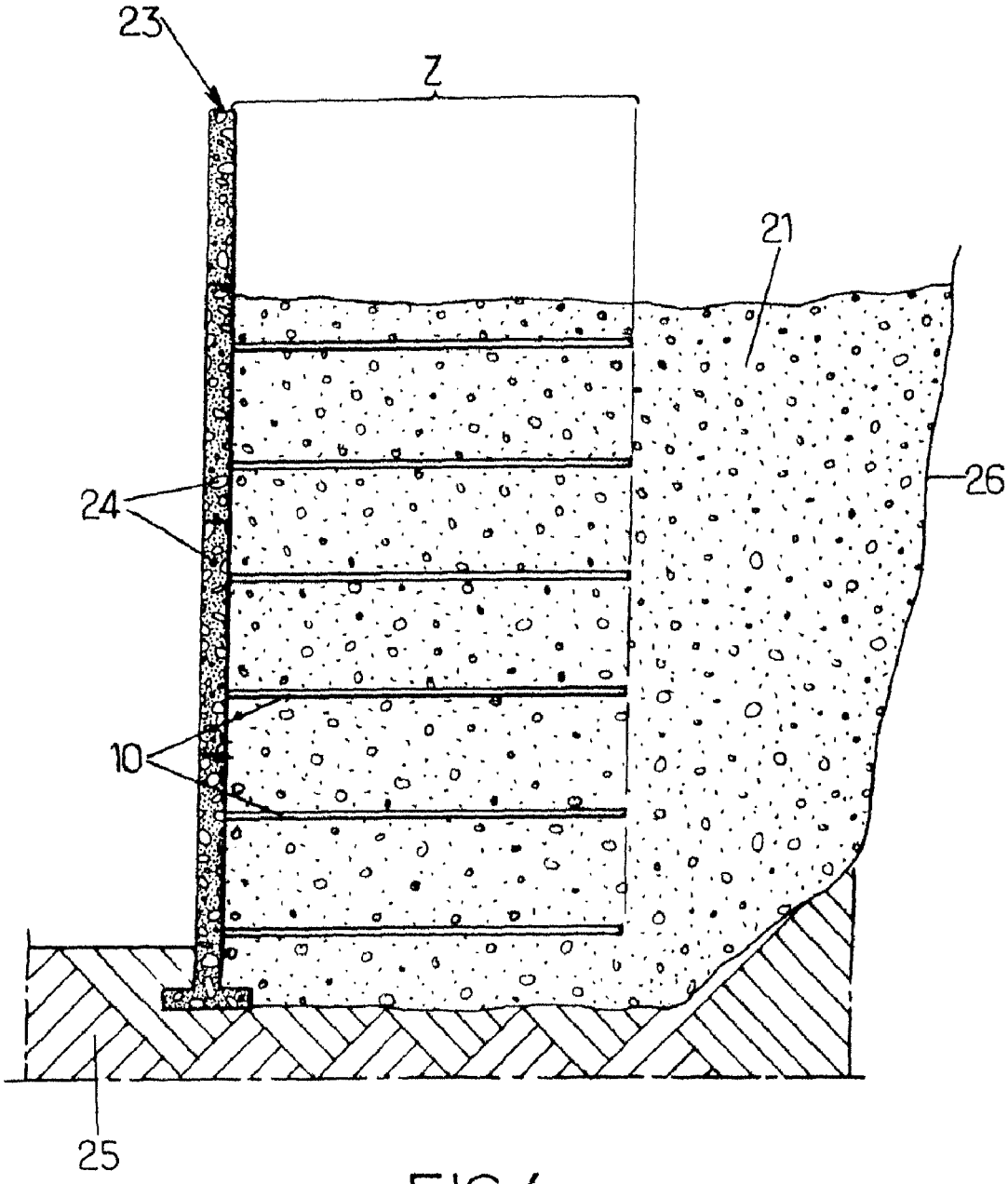
FIG. 4 is a schematic cross-sectional view of a reinforced earth structure according to the invention under construction.
Figure 5:
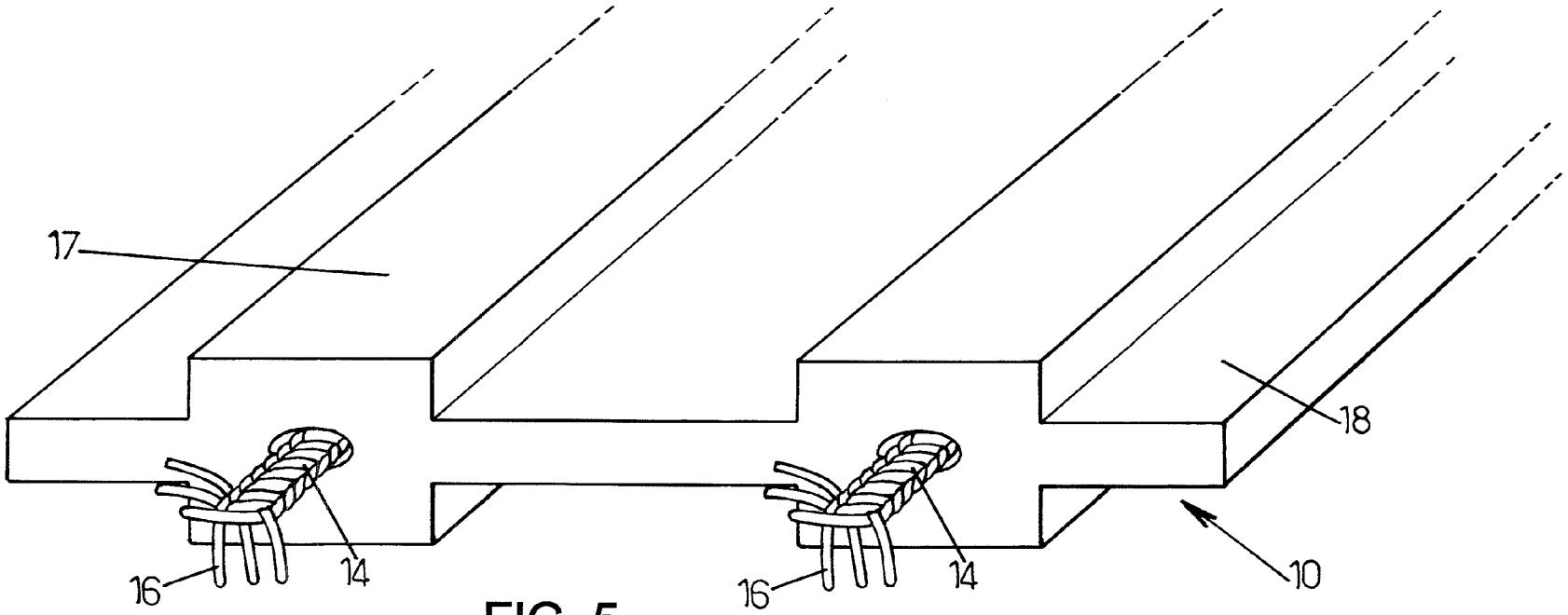
FIG. 5 is a perspective view of a fourth embodiment which comprises multiple central parts connected to each other by a lateral part.

FIG. 4 shows such a method. Compacted backfill 20, in which stabilising strips 10 according to the invention are distributed, is delimited on the front surface of the structure by a facing 23 formed by juxtaposing precast elements 24, and on the rear surface by the ground 25 against which the retaining wall is erected.

To ensure the cohesion of the retaining wall, the stabilising strips 10 can be connected to the facing elements 24, and extend over a certain distance within the backfill 21. These stabilising strips 10 contribute to the reinforcement of the earth located in a reinforced zone Z behind the facing 23.

In this reinforced zone Z, the backfill material 21 is very strong because it is reinforced by the stabilising strips 10. It is thus able to withstand the shear stresses that are exerted due to the tensile forces to which the stabilising strips 10 are subjected. This reinforced zone Z must naturally be sufficiently thick to support the facing 23.

The simple connection of stabilising strips to the back of the facing elements 24 thus allows for the facing to be held against the backfill, of which there can be a large volume.

In one possible embodiment, the stabilising strips 10 are incorporated when the facing elements 24 are manufactured. In the frequent case that the elements 24 are made from precast concrete, part of the stabilising strips 10 can be embedded in the cast concrete of an element 24. In the example of structural configuration shown in FIG. 4, the stabilising strips 10 are arranged in staggered superimposed horizontal layers over the height of the structure.

The following steps can be followed to build the structure shown in FIG. 4;

a) position some of the facing elements 24 so that backfill material can then be added over a certain height. In a known manner, the assembly and positioning of the facing elements can be facilitated by fasteners placed between them;

b) install the stabilising strips 10 on the backfill already there, exerting slight tension on them;

c) add backfill material on top of the layer of stabilising strips 10 that has just been installed, up to the next level of stabilising strips 10 on the rear surface of the facing elements 24. This backfill material is compacted as it is added;

d) repeat steps a) to c) until the upper level of the backfill is reached.

It must be noted that a large number of variants can be made to the structure described above and its method of realization.

It is also possible to implement the method according to the invention with strips arranged in a zigzag pattern. The strips can also be used to secure the facing 24 to the wall 26 of earth by fixing to said wall, for example using hooks or loops nailed to the wall 26 or by any other means known to a person skilled in the art.

The invention is not limited to these types of embodiment and must be interpreted in a non-limitative manner, encompassing any equivalent embodiment.

The invention claimed is:

1. Reinforced stabilising strip intended for use in reinforced earth structures, comprising a longitudinal part, said longitudinal part comprising along at least part of its length, at least one cord arranged approximately longitudinally and embedded in the bulk of said longitudinal part, wherein the material forming the fibres or yarn of the cord is polymer-based, and the cord is plaited from at least three fibres.

2. Stabilising strip according to claim 1, characterised in that the material forming the longitudinal part is polymer-based.

3. Stabilising strip according to claim 1, characterised in that said longitudinal part is presented in the form of at least one central part, said central part having at least one lateral part that protrudes laterally along the longitudinal part to rub against the earth.

4. Stabilising strip according to claim 3, in which the lateral part extends longitudinally.

5. Stabilising strip according to claim 1, in which the longitudinal part comprises several central parts connected to each other by a lateral part.

6. Stabilising strip according to claim 1, in which the cord is a cord plaited from at least six fibres.

7. Stabilising strip according to claim 1, in which the cord comprises a central core.

8. Reinforced earth structure comprising at least one stabilising strip according to claim 1.

9. Construction method for a reinforced earth structure, in which a facing is arranged over a front surface of the structure delimiting a volume to be backfilled, reinforcements are arranged in one zone of said volume, backfill material is placed in said volume and the backfill material is compacted, characterised in that said reinforcements comprise at least one stabilising strip according to claim 1.

* * * * *